United States Patent [19]

Barzynski

[11] Patent Number: 4,523,208

[45] Date of Patent: Jun. 11, 1985

[54] HEAT-SENSITIVE RECORDING MATERIAL

[75] Inventor: Helmut Barzynski, Bad Durkheim, Fed. Rep. of Germany

[73] Assignee: BASF Aktiengesellschaft, Fed. Rep. of Germany

[21] Appl. No.: 554,326

[22] Filed: Nov. 22, 1983

[30] Foreign Application Priority Data

Nov. 27, 1982 [DE] Fed. Rep. of Germany ..... 3243945

[51] Int. Cl.[3] ..... B41M 5/18

[52] U.S. Cl. ..... 346/214; 346/216; 346/217; 346/225; 427/150; 427/151

[58] Field of Search ..... 346/216, 225, 214, 217, 346/218, 221, 224; 427/150, 151

[56] References Cited

U.S. PATENT DOCUMENTS

| | | | |
|---|---|---|---|
| 4,076,532 | 2/1978 | Gottermeir | 428/913 X |
| 4,303,719 | 12/1981 | Vassiliades | 346/216 |
| 4,312,522 | 1/1982 | Yamaguchi et al. | 346/216 |
| 4,446,209 | 5/1984 | Iwakura et al. | 346/216 |

FOREIGN PATENT DOCUMENTS

| | | | |
|---|---|---|---|
| 0067793 | 12/1982 | European Pat. Off. | 346/216 |
| 2931083 | 6/1978 | Fed. Rep. of Germany | 346/225 |
| 2701491 | 7/1980 | Fed. Rep. of Germany | 346/225 |
| 2028526 | 3/1980 | United Kingdom | 346/214 |

OTHER PUBLICATIONS

F. Drahowsal and D. Klamann, "Monatshefte" 82, (1951) 452 et seq.

*Primary Examiner*—Bruce H. Hess
*Attorney, Agent, or Firm*—Keil & Weinkauf

[57] ABSTRACT

A heat-sensitive recording material comprises a heat-sensitive layer which is applied onto a base and contains a color-producing substance, which is usually colorless or only slightly colored, and an activator which, under the action of heat, causes the color-producing substance to produce a coloration. In accordance with the invention, the heat-sensitive layer contains a sulfonic acid ester, in particular of a secondary alcohol, as the activator.

9 Claims, No Drawings

HEAT-SENSITIVE RECORDING MATERIAL

The present invention relates to a heat-sensitive recording material which comprises a heat-sensitive layer which is applied onto a base and contains a color-producing substance, which is usually colorless or only slightly colored, and an organic compound which, when heated, causes the color-producing substance to produce a coloration.

The conventional heat-sensitive recording materials generally consist of a base, for example of paper or a plastic film or foil, onto which the heat-sensitive layer is applied. The heat-sensitive layer, which is colorless or only slightly colored, usually contains a color-producing substance and a substance (activator) which, when the heat-sensitive layer is heated, is capable of causing the color-producing substance to produce a coloration. Particularly suitable color-producing substances are leuco bases of diphenylmethane, triphenylmethane, fluorane, phenothiazine, xanthene, thioxanthene and acridine dyes and other dye derivatives which release the actual dye when the acid concentration is increased. The activators used for the production of color are, in particular, acidic organic substances, e.g. phenols.

However, the conventional heat-sensitive recording materials are not completely satisfactory. For example, their response to heat is frequently inadequate for rapid recording and a high recording density. Moreover, the heat-sensitive recording materials have a non-homogeneous composition, i.e. the color-producing substance and the activator are present as discrete particles or crystals side by side, and mixing, together with color production, takes place only when heat-induced melting occurs. As a result, the recording materials have a low resolving power. There is therefore a need for further, novel, heat-sensitive recording materials with improved properties.

It is an object of the present invention to provide novel heat-sensitive recording materials which have a large variety of uses. These recording materials should substantially overcome the disadvantages of the conventional products of this type, and in particular should possess high heat-sensitivity, a high recording density and a high resolving power so that they can also be used as transparent thermographic films.

I have found that this object is achieved if the heat-sensitive recording material contains a sulfonic acid ester, in particular of a secondary alcohol, as the activator which, when the heat-sensitive recording material is heated, causes the color-producing substance to produce a coloration.

The present invention accordingly relates to a heat-sensitive recording material which comprises a heat-sensitive layer which is applied onto a base and contains a color-producing substance, which is usually colorless or only slightly colored, and an activator which, under the action of heat, causes the color-producing substance to produce a coloration, wherein the heat-sensitive layer contains a sulfonic acid ester, in particular of a secondary alcohol, as the activator.

The heat-sensitive layer of the novel recording material contains, as the color-producing component, the substances, as described in the relevant literature, which are conventionally used for recording materials of this type. Examples of such substances are the leuco bases or leuco-lactone forms of diarylmethane, triarylmethane, fluorane, phenothiazine, xanthene, thioxanthene, spiropyran or acridine dyes. In general, it is possible to use any dye derivative which is colorless or only slightly colored and which liberates the actual dye when the acid concentration is increased.

Examples of such color-producing substances are leuco crystal violet, leuco malachite green, benzoyl leuco methylene blue, Michler's hydrol (4,4'-bis(dimethylamino)benzhydrol), Michler's hydrol benzyl ether, 3,3-bis(p-dimethylaminophenyl)- 6-dimethylamino phthalide, 7-diethylamino-2,2'-spirodi-(2H-1-benzopyran) and 3-diethylamino-7-o-chloranilino fluorane.

In accordance with the invention, the heat-sensitive recording material contains a sulfonic acid ester as an activator which, when the recording material is heated, results in color production. Particularly suitable activators are sulfonates of secondary alcohols, and preferred sulfonates are those derived from secondary saturated aliphatic alcohols of 3 to 12 carbon atoms or from cycloaliphatic alcohols. The secondary alcohols can be mono-alcohols, diols or polyols. Examples of particularly advantageous aliphatic secondary alcohols are isopropanol, butane-2-ol, butane-2,3-diol and n-hexane-2,5-diol. An example of a cycloaliphatic alcohol is cyclohexanol. The sulfonic acid esters according to the invention are based in particular on aromatic sulfonic acids, preferably benzenesulfonic acid or toluenesulfonic acid. Examples of sulfonic acid esters which have proven particularly advantageous when used in the heat-sensitive recording materials are cyclohexyl tosylate, butane-2,3-diol ditosylate, sec.-butyl tosylate and hexane-2,5-diol ditosylate.

In addition to the preferred sulfonates obtained from secondary alcohols and aromatic sulfonic acids, sulfonates based on aliphatic sulfonic acids, e.g. methane-sulfonic acid, and/or on primary saturated aliphatic alcohols, e.g. n-butanol, n-octanol, neopentylglycol or glycerol, or on unsaturated or aromatic alcohols, e.g. allyl alcohol, benzyl alcohol or phenyl-1-propanediol, can also be employed, in accordance with the invention, as activators, although these compounds are slightly less advantageous.

In the novel recording material, the ratio of color-producing substance to activator can vary within wide limits. The activator is always present in an amount such that, when the recording material is heated, the desired color change and color intensity are obtained. For this purpose, the color-producing substance and the activator are usually employed in a molar ratio of from 1:100 to 1:2.

To produce the heat-sensitive layer, it is advantageous and in general customary, although not absolutely necessary, to employ the color-producing substance and the activator together with a binder. The binders used consist of compounds which do not themselves undergo a color change when heated and which firmly bind the color-producing substance and the activator, as well as any other additives present, to the surface of the base of the heat-sensitive recording material. Examples of suitable binders of this type are waxes, such as vegetable, mineral and/or mineral oil waxes, as well as fatty acid amide waxes, and in particular film-forming polymers. Examples of film-forming polymers which are particularly useful binders are ethylene polymers, propylene polymers, styrene polymers, acrylate and methacrylate polymers, vinyl acetate polymers, vinyl alcohol polymers, vinyl chloride polymers, acrylonitrile polymers, butadiene and isoprene polymers, epoxy resins, cellulose derivatives, natural and synthetic rubbers, nylons, polyurethanes and polycarbonates; polyvinyl chloride, polystyrene, polyvinyl alcohol and polymethyl methacrylate are particularly preferred.

It may also be desirable and advantageous if the heat-sensitive layer of the recording material contains other, conventional additives, for example plasticizers for the binder, polymer stabilizers, optical brighteners, white or colored pigments, etc. The heat-sensitive layer generally contains such additives in amounts of not more than 30% by weight, based on the heat-sensitive layer.

Suitable bases for the heat-sensitive layer are those which are conventionally used for heat-sensitive recording materials of the type under discussion. These include, in particular, any natural or synthetic papers which may or may not have a surface coating, including photographic papers, and plastic films and foils, metals and glass. Plastic films or foils, for example composed of polyesters or nylons, are particularly suitable bases where it is intended to use the heat-sensitive recording material to produce a transparent image. The base is in general dimensionally stable, and can be flexible or rigid. To ensure better adhesion of the heat-sensitive layer, the base can be pretreated mechanically and/or chemically, or can be provided with an adhesive layer.

The novel heat-sensitive recording material can be produced, for example, by dissolving the components of the heat-sensitive layer in a suitable solvent, applying the solution onto the base by a conventional technique to give a layer of the desired thickness, evaporating the solvent and drying the heat-sensitive layer at a temperature below that at which color production takes place. The amount of heat-sensitive layer applied onto the base is preferably from 2 to 25 g/m$^2$ in the dry state. If desired, the heat-sensitive layer can, after application onto the base, also be subjected to a surface treatment, for example to produce a particularly smooth surface. To produce coated papers, an aqueous dispersion containing a finely divided color-producing substance and activator, as well as a little dissolved binder, e.g. polyvinyl alcohol, is generally applied onto the paper to give a layer having the desired thickness, and drying is effected below the temperature at which color production takes place.

The heat-sensitive recording materials according to the invention have a good response to heat and consequently permit rapid recording, have a high resolving power and give faithful recordings. The temperatures at which color production takes place correspond to those for the conventional heat-sensitive recording materials. The recording materials can therefore be used in any field in which these products are conventionally employed, in particular for thermography and for the production of heat-sensitive transparent films having a long shelf life, such as heterogeneously coated thermographic papers.

The Examples which follow illustrate the invention. Parts and percentages are by weight, unless stated otherwise.

Preparation of the sulfonic acid esters (a) Chlorine-free sulfonates were prepared according to the methods described by F. Drahowzal and D. Klamann in Monatshefte 82 (1951) 452 et seq. The reaction of a sulfonyl chloride with an alkali in ether at −5° C. proved the most useful one. The characteristic properties of tosylates prepared for the first time are listed below:

| Toluene-sulfonate | Melting point °C. | Decomposition temperature °C. | Yield % |
|---|---|---|---|
| Phenylprop-1-yl tosylate | 49–51 | 188 | 76.1 |
| Butane-2,3-diol ditosylate | 78–81 | 214–217 | 78.7 |
| Hexane-2,5-diol ditosylate | 81–83 | 139 | 37.8 |
| Neopentylglycol ditosylate | 118–120 | 233–237 | 25.5 |
| Neopentylglycol hydroxypivalate ditosylate | 101–103 | 210–215 | not determined |

(b) A mixture of 179 g of toluenesulfonyl chloride, 113 g of cyclohexanol and 500 ml of n-hexane was heated at the boil. When all solid material had dissolved, a mixture of 109 g of triethylamine and 1.1 g of diazabicyclooctane was added dropwise in the course of 15 minutes. A salt slowly began to be precipitated during the addition. The mixture was stirred under reflux for 8 hours, after which it was cooled, the hydrochloride was filtered off under suction and the filtrate was washed neutral in a separating funnel, twice with n/10 HCl and twice with water. Two organic phases formed, and these were combined by the addition of 87 ml of cyclohexane. The combined organic phases were dried over $Na_2SO_4$, and were then left to stand at room temperature for 1 week. The resulting very large fine crystals of cyclohexyl tosylate were filtered off under suction and washed with a little cold petroleum ether. Yield: 58%, mp.: 42°–44° C., decomposition temperature: 140° C., chlorine content 0.01%.

EXAMPLES 1 to 15

The following mixtures were prepared:

30 parts of sulfonic acid ester (see Table),
10 parts of polymethyl methacrylate,
5 parts of 3'-phenyl-7-diethylamino-2,2'-spirodi(2H-1-benzopyran),
0.01 part of N,N'-bis(3-aminopropyl)ethylenediamine and
300 parts of methylene chloride.

Commercial uncoated mat paper having a weight per unit area of 32 g/m$^2$ was impregnated with the mixture and then dried. Blue line patterns were produced on the paper by means of radiation from a $CO_2$-CW laser (4 watt). The heat-sensitivity could be determined from the maximum speed of the moving laser beam at which a blue coloration was just observable; the values shown in the Table have been normalized with respect to the velocity for sec.-butyl tosylate. The shelf life of the thermographic papers was determined by storage in a heating chamber; the blue coloration which results from hydrolysis during storage in standard moist air at room temperature for 2 months was also measured. The results are shown in the Table.

TABLE

| Example No. | Sulfonic acid ester | Relative heat-sensitivity (sec.-butyl tosylate = 1.000) | Shelf Life (days) Storage at 50° C. | 70° C. | 100° C. | Coloration due to hydrolysis after 2 months |
|---|---|---|---|---|---|---|
| 1 | Ethyl tosylate | 0.59 | 3 | 1 | 0.02 | – |
| 2 | n-Butyl benzene-sulfonate | 0.85 | 3 | 1 | 0.007 | – |
| 3 | n-Butyl tosylate | 0.89 | 3 | 1 | 0.007 | (+) |
| 4 | n-Octyl methanesulfonate | 0.42 | 5 | 1 | 0.007 | – |
| 5 | Neopentylglycol ditosylate | 0.75 | 20 | 5 | 3 | – |
| 6 | Glycerol ditosylate | 0.63 | 20 | 3 | 3 | – |
| 7 | Neopentylglycol hydroxy-pivalate ditosylate | 0.89 | 30 | 5 | 3 | – |
| 8 | Allyl tosylate | 1.30 | 0.01 | <0.007 | <0.007 | ++ |
| 9 | Benzyl benzenesulfonate | 1.15 | 0.1 | 0.01 | <0.007 | ++ |
| 10 | Benzyl tosylate | 1.20 | 1 | 0.01 | <0.007 | ++ |
| 11 | Phenylprop-1-yl tosylate | 0.85 | 3 | 1 | <0.02 | – |
| 12 | sec.-Butyl tosylate | 1.000 | 3 | 1 | 0.007 | – |
| 13 | Cyclohexyl tosylate | 1.25 | 3 | 1 | 0.007 | – |
| 14 | Butane-2,3-diol ditosylate | 0.93 | 20 | 5 | 1 | – |
| 15 | Hexane-2,5-diol ditosylate | 1.05 | 3 | 0.5 | 0.007 | (+) |

The Table shows clearly that in principle all sulfonic acid esters can be used as activators in heat-sensitive recording materials. The sulfonates of unsaturated aromatic alcohols or saturated.secondary alcohols are substantially more sensitive than those of saturated primary alcohols. Because of their particularly high stability to hydrolysis, the sulfonates of saturated secondary alcohols are particularly preferred.

EXAMPLE 16

A mixture having the following composition was prepared:

60 parts of polystyrene,
30 parts of butane-2,3-diol ditosylate,
6 parts of tricresyl phosphate,
3.5 parts of crystal violet leucobase,
0.1 part of N,N'-bis(3-aminopropyl)ethylenediamine and
300 parts of methylene chloride.

The solution was applied onto a 30 μm thick polyester foil by means of a knife-coater in an amount such that a 20 μm thick dry layer was obtained. A metal mask was placed on top, and an image was produced in the heat-sensitive layer by means of a stream of warm air.

EXAMPLES 17 to 20

Using a small thermoprinter, an inscription was produced on the heat-sensitive papers prepared as described in Examples 12 to 15. A satisfactory thermoprint was obtained in each case.

I claim:

1. A heat-sensitive recording material which comprises a heat-sensitive layer which is applied onto a base and contains a color-producing substance, which is usually colorless or only slightly colored, and an activator which, under the action of heat, causes the color-producing substance to produce a coloration, wherein the activator is a sulfonic acid ester.

2. A heat-sensitive recording material as claimed in claim 1, which contains, as the activator, an ester of an aromatic sulfonic acid.

3. A heat-sensitive recording material as claimed in claim 2, which contains, as the activator, an ester of benzenesulfonic acid and/or an ester of toluenesulfonic acid.

4. A heat-sensitive recording material as claimed in claim 3, which contains, as the activator, isopropyl toluenesulfonate, but-2-yl toluenesulfonate, butane-2,3-diol toluenesulfonate or hexane-2,5-diol toluenesulfonate.

5. A heat-sensitive recording material as claimed in claim 1, which contains, as the activator, a sulfonate of a cycloaliphatic alcohol.

6. A heat-sensitive recording material as claimed in claim 1, which contains, as the activator, a sulfonate of a saturated secondary aliphatic alcohol of 3 to 12 carbon atoms.

7. A heat-sensitive recording material as claimed in claim 1, which contains, as the color-producing substance, a diarylmethane, triarylmethane, fluorane, phenothiazine, xanthene, thioxanthene, spiropyran or acridine dye in the form of its leuco base or in its leuco-lactone form.

8. A heat-sensitive recording material as claimed in claim 1, wherein the heat-sensitive layer additionally contains a film-forming polymer as the binder.

9. A heat-sensitive recording material as claimed in claim 8, wherein the binder is polystyrene, polyvinyl chloride, polymethyl methacrylate or polyvinyl alcohol.

* * * * *